US005277731A

United States Patent [19]

Krimsky et al.

[11] Patent Number: 5,277,731

[45] Date of Patent: Jan. 11, 1994

[54] METHOD OF AND APPARATUS FOR FORMING A BUTT SPLICE IN A WEB UNWINDER

[75] Inventors: Leonard C. Krimsky, Englewood, N.J.; Henk V. Rietschoten, Blooming Grove, N.Y.

[73] Assignee: Worldwide Processing Technologies, Inc., Allendale, N.J.

[21] Appl. No.: 976,325

[22] Filed: Nov. 13, 1992

[51] Int. Cl.[5] ..... B31F 5/00

[52] U.S. Cl. ..... 156/159; 156/157; 156/304.1; 156/504; 156/505; 242/58.4

[58] Field of Search ..... 156/157, 159, 304.1, 156/502, 504, 505; 242/58.1, 58.2, 58.3, 58.4, 58.5, 58.6

[56] References Cited

U.S. PATENT DOCUMENTS

| | | | |
|---|---|---|---|
| 3,276,710 | 10/1966 | Zernov et al. | 242/59 |
| 3,467,334 | 2/1968 | Chestnut et al. | 242/58.3 |
| 3,654,035 | 1/1970 | Takimoto | 156/505 |
| 3,939,031 | 11/1974 | Takimoto | 156/505 |
| 4,067,760 | 3/1976 | Nelson | 156/157 |
| 4,097,323 | 1/1976 | De Roeck et al. | 156/159 |
| 4,169,752 | 11/1977 | Tokuno | 156/157 |
| 4,234,365 | 12/1978 | Shimizu et al. | 156/64 |
| 4,238,261 | 10/1978 | Tetro | 156/157 |
| 4,315,794 | 4/1980 | Palmieri | 156/504 |
| 4,338,154 | 9/1980 | Berthelot et al. | 156/462 |
| 4,363,695 | 12/1982 | Marass | 156/504 |
| 4,530,265 | 7/1985 | Lee et al. | 83/337 |
| 4,738,739 | 4/1988 | Schoonderbeek | 156/159 |
| 4,905,924 | 3/1990 | Moore | 242/58.5 |
| 5,064,488 | 11/1991 | Dickey | 156/159 |

*Primary Examiner*—David A. Simmons
*Assistant Examiner*—Mark A. Osele
*Attorney, Agent, or Firm*—Shenier & O'Connor

[57] ABSTRACT

A method of and apparatus for forming a butt splice between an expiring web and a new web in which both webs are concomitantly cut at a location upstream of a lap splice formed between the webs and a length of splicing tape is applied at the location to form the butt splice. After the butt splice is formed, the new web leading portion which is severed during the cutting operation is stripped from the expiring web. Preferably a stiffener strip is adhered to the expiring web with a breakaway adhesive and to the new web with a firm adhesive during the formation of the lap splice to facilitate the subsequent stripping operation.

15 Claims, 8 Drawing Sheets

METHOD OF AND APPARATUS FOR FORMING A BUTT SPLICE IN A WEB UNWINDER

FIELD OF THE INVENTION

The invention is in the field of web splicing and, more particularly, relates to an improved system for forming a butt splice in a web unwinding arrangement.

BACKGROUND OF THE INVENTION

There are many instances in the prior art in which a web of material is fed continuously through processing apparatus which coats or otherwise treats the web. Also known in the prior art are devices for feeding the web continuously to the process station from a plurality of successive rolls, the ends of which are automatically spliced together without interruption of the web feed.

Many of the automatic web splicers of the prior art form a lap splice in which a portion of the web from the expiring roll overlies a portion of the web from the new roll with the under surface of the overlapped portion of one of the webs adhered to the upper surface of the other web. While such a splice is satisfactory in most instances, it is not suitable in certain cases in which a double thickness of web is not readily tolerated. For example, there are processing systems in which the web being treated must pass through the nip between a pair of closely spaced rolls or through a similar narrow gap. In such a case, particularly where the web is traveling at a relatively high speed, the double thickness of web at the lap splice may damage the apparatus by denting one of the rolls or destroying the roll support bearings. Further, owing to the shock applied to the web in the region of the splice, the web may break even if the apparatus is not damaged. The resultant stoppage of the continuous process obviously is undesirable.

A number of attempts have been made in the prior art automatically to form a butt splice in which the trailing edge of the expiring web butts the leading edge of the new web so that there is no overlap. Such attempts, however, have for various reasons not been as successful as is desired. One of the most difficult problems has been the disposal of the leading edge portion which is cut from the new web in the course of forming the butt splice.

One example of an attempt in the prior art to form a butt splice is shown in DeRoeck et al U.S. Pat. No. 4,097,323. In the arrangement shown in this patent, the web being unwound passes around the portion of the surface of a vacuum drum from about the six o'clock position to about the twelve o'clock position thereof. A new roll is contained by a flexible strap which is held around the roll by a releasable buckle. When the new web is to be spliced to the expiring web, a buckle release roll is brought into operative position to release the buckle within one revolution of the new roll. Once the buckle has been released, the strap falls away and the leading edge of the new roll is fed by a pair of rolls into the space between the expiring web and the vacuum roll at the six o'clock position. Thus, the new web is carried around the vacuum roll together with the expiring web. After the leading edge of the new web has thus been introduced between the vacuum drum and the expiring web and at approximately the five-thirty location on the vacuum drum, both webs are cut. The vacuum drum is provided with an indentation for permitting this operation to be achieved. After the cut is made, the tail of the expiring web falls away or is carried away by the knife roller. At about the three o'clock position on the vacuum drum, a taping roll applies a length of tape to the cut ends of the web to form the butt splice. At the twelve o'clock position the expiring web to which the new web has been spliced is carried away by a takeoff roller and the leading portion of the new web which is severed by the knife roll is discharged.

Not only does the DeRoeck system involve the complication of holding the new web with a flexible strap and releasable buckle and the buckle release mechanism, but also no provision is made for ensuring that the severed leading portion of the new web is not separated from both the expiring web and the surface of the vacuum drum in such a way that it will not interfere with the unwinding operation or a subsequent process.

SUMMARY OF THE INVENTION

One object of our invention is to provide an improved method of and apparatus for forming a butt splice between an expiring web and a new web in a web unwinder.

Another object of our invention is to provide a method of and apparatus for forming a butt splice which overcomes the defects of butt splicing systems of the prior art.

A further object of our invention is to provide an improved method of and apparatus for forming a butt splice in such a way as to ensure that cut portions of web will not interfere with the unwinding operation or subsequent processing of the web.

Still another object of our invention is to provide an improved method of and apparatus for splicing webs in which the web being processed is required to pass through narrow gaps.

Yet another object of our invention is to provide an improved method of and apparatus for forming a butt splice which is simple and certain.

A still further object of our invention is to provide an improved method of and apparatus for forming a butt splice in a high speed processing apparatus.

Other and further objects of our invention will appear from the following description.

BRIEF DESCRIPTION OF THE DRAWINGS

In the accompanying drawings to which reference is made in the instant specification and which are to be read in conjunction therewith and in which like parts are indicated by like reference characters in the various views.

DESCRIPTION OF THE PREFERRED EMBODIMENT

Figure 1:
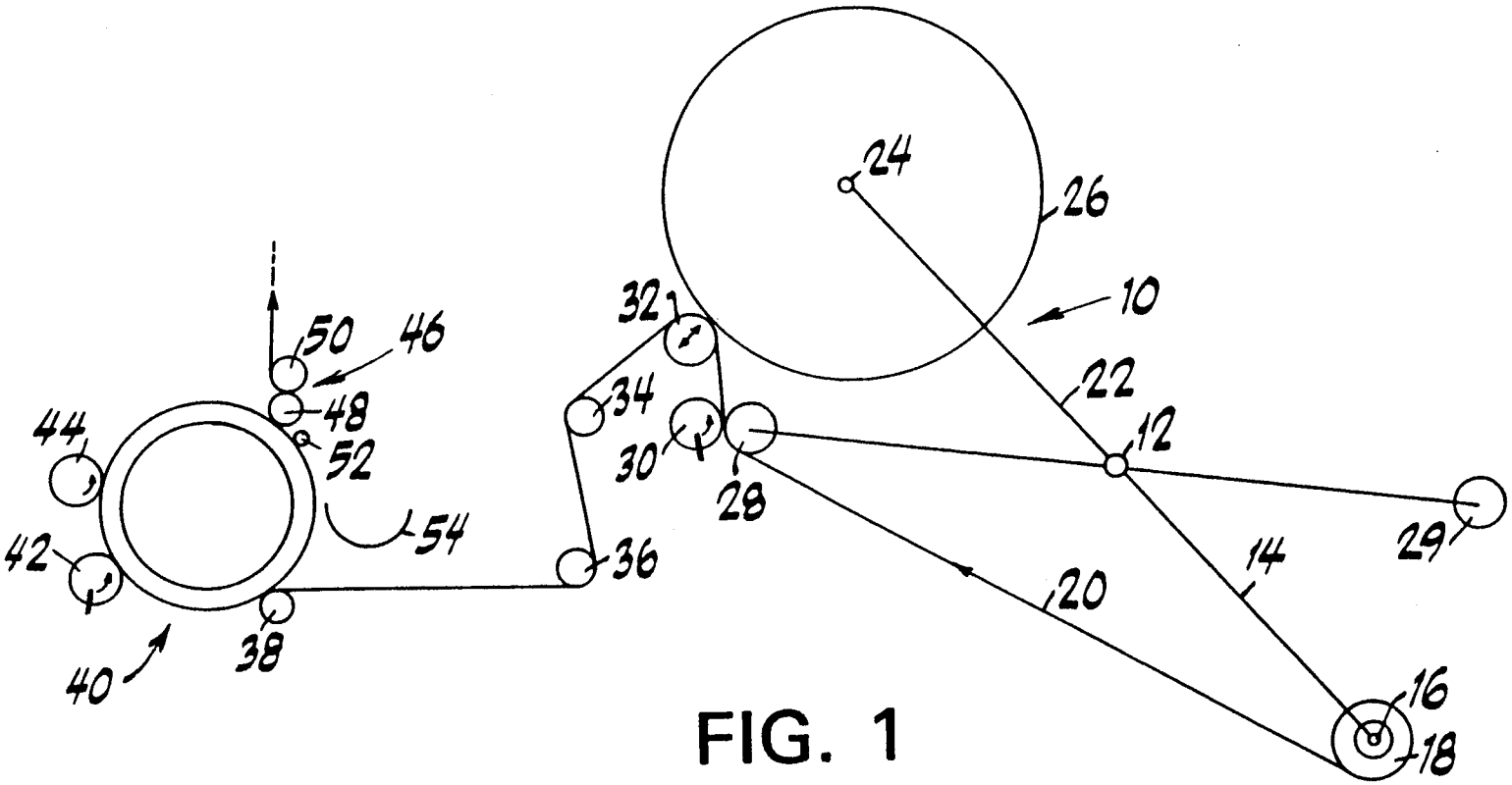
FIG. 1 is a schematic view illustrating our improved method and apparatus for forming a butt splice.

Referring now to FIG. 1 of the drawings, one form of apparatus for carrying out our method includes an unwind turret indicated generally by the reference character 10 having a central shaft 12. One arm 14 supported on shaft 12 for rotation therewith carries a first core 16 of an expiring roll 18 of a web 20. A second arm 22 on shaft 12 and extending generally diametrically oppositely to the arm 14 carries a core 24 of a new roll 26 of web.

The web 20 from the expiring roll 18 passes around a rubber covered guide roll 28 which cooperates with a knife roll 30 in a manner to be described. From the roll 28 the web passes around a bumper roll 32 to a guide roll 34. As is known in the art, when the turret indexes a rubber covered guide roll 29 occupies the position of roll 28 and cooperates with knife roll 30 on the next splicing operation.

The apparatus just described is adapted to form a lap splice between the web from expiring roll 18 and the web on the new roll 26. The lap splice between the expiring web and the new web, as modified by our method in a manner to be described hereinbelow, may be performed by an apparatus such as is shown and described in Lee et al U.S. Pat. No. 4,530,265.

After the lap splice has been formed, the spliced webs travel around guide rolls 34 and 36 to an intake roll 38 which forms a nip with a vacuum drum indicated generally by the reference character 40. The web travels around with the vacuum drum 40 past the knife roll 42 and a taping roll 44 to an output roll stack 46 including a takeoff roll 48 and a roll 50. As will be explained more fully hereinbelow, the butt splice is formed as the web passes the rollers 42 and 44. Further as will be explained more fully hereinbelow, the separation of the severed leading portion of the new web from the butt-spliced webs takes place at roll 48. This severed portion of the new web then passes a nip roll 52 which ensures that it is stripped from the expiring web and directed to a suitable receptacle 54.

Figure 2:
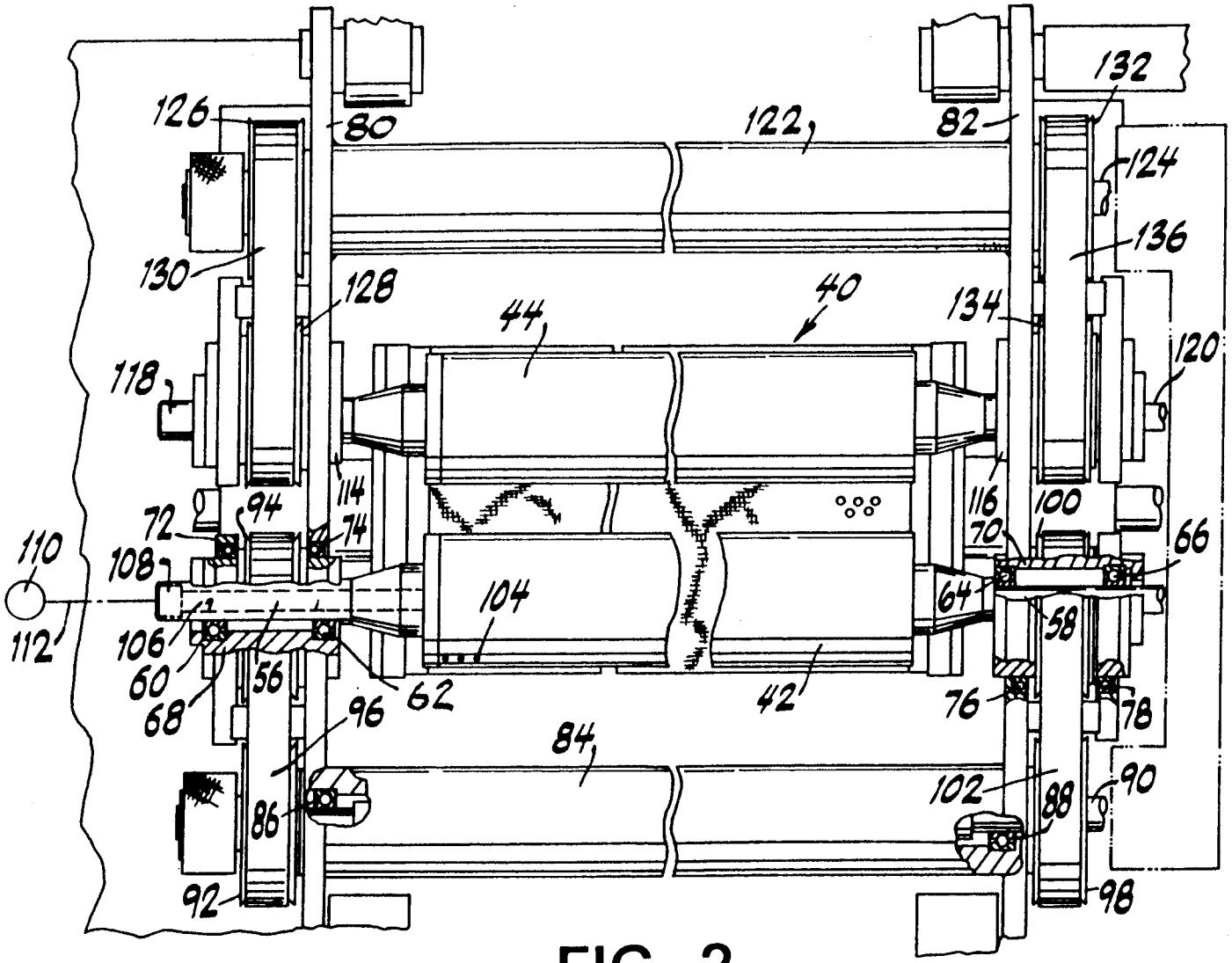
FIG. 2 is a front elevation of a portion of our improved apparatus for carrying out our improved method of forming a butt splice.

Referring now to FIG. 2, we mount respective stub shafts 56 and 58 at the ends of the knife bar or roll 42 in pairs of bearings 60, 62, 64 and 66, supported in respective eccentrics 68 and 70. A first pair of bearings 72 and 74 support the eccentric 68 on a left-hand frame member 80 as viewed in FIG. 2. Similarly, a pair of bearings 76 and 78 support the eccentric 70 on a right-hand frame member 82.

A quill 84 secured to frame members 80 and 82 by any suitable means such for example as welding or the like receives a pair of bearings 86 and 88 which rotatably support a shaft 90. Respective pulleys 92 and 94 carried by shaft 90 and by end shaft 56 receive a belt 96 which couples the left end of shaft 90 as viewed in FIG. 2 to the end shaft 56.

Pulleys 98 and 100 carried respectively by the right end of shaft 90 as viewed in FIG. 2 and by quill 84 receive a belt 102 to provide a coupling between shaft 90 and end shaft 58.

Preferably we form the knife roll 42 with perforations 104 leading into a bore 106 in end shaft 56. A coupling 108 connects bore 106 to a conduit indicated schematically at 112 in FIG. 2. An exhaust fan 110 connected to the conduit 112 provides sufficient suction at perforations 104 to carry away the severed tail portion of the expiring web in a manner to be described.

Taping roll 44 is rotatably mounted in a pair of eccentrics 114 and 116 carrying bearings (not shown) which receive the end shafts 118 and 120 of the taping roll. A quill 122 secured between frame members 80 and 82 in a manner similar to quill 84 rotatably supports a shaft 124. Left-hand pulleys 126 and 128 carried respectively by shaft 124 and by shaft 118 receive a belt 130. Similarly, right-hand pulleys 132 and 134 carried respectively by shaft 124 and by shaft 120 receive a belt 132.

From the structure just described, it will be appreciated that belts 96 and 102 provide a drive for coupling shaft 90 to the knife roll 42 to position the knife roll in a manner to be described. Similarly, belts 130 and 136 couple shaft 124 to the taping roll 44 to position the same. As will be apparent from the description hereinbelow, we provide suitable motors for driving shafts 90 and 124. In addition, drives are provided for rotating both the knife roll 42 and the taping roll 44.

Figure 3:
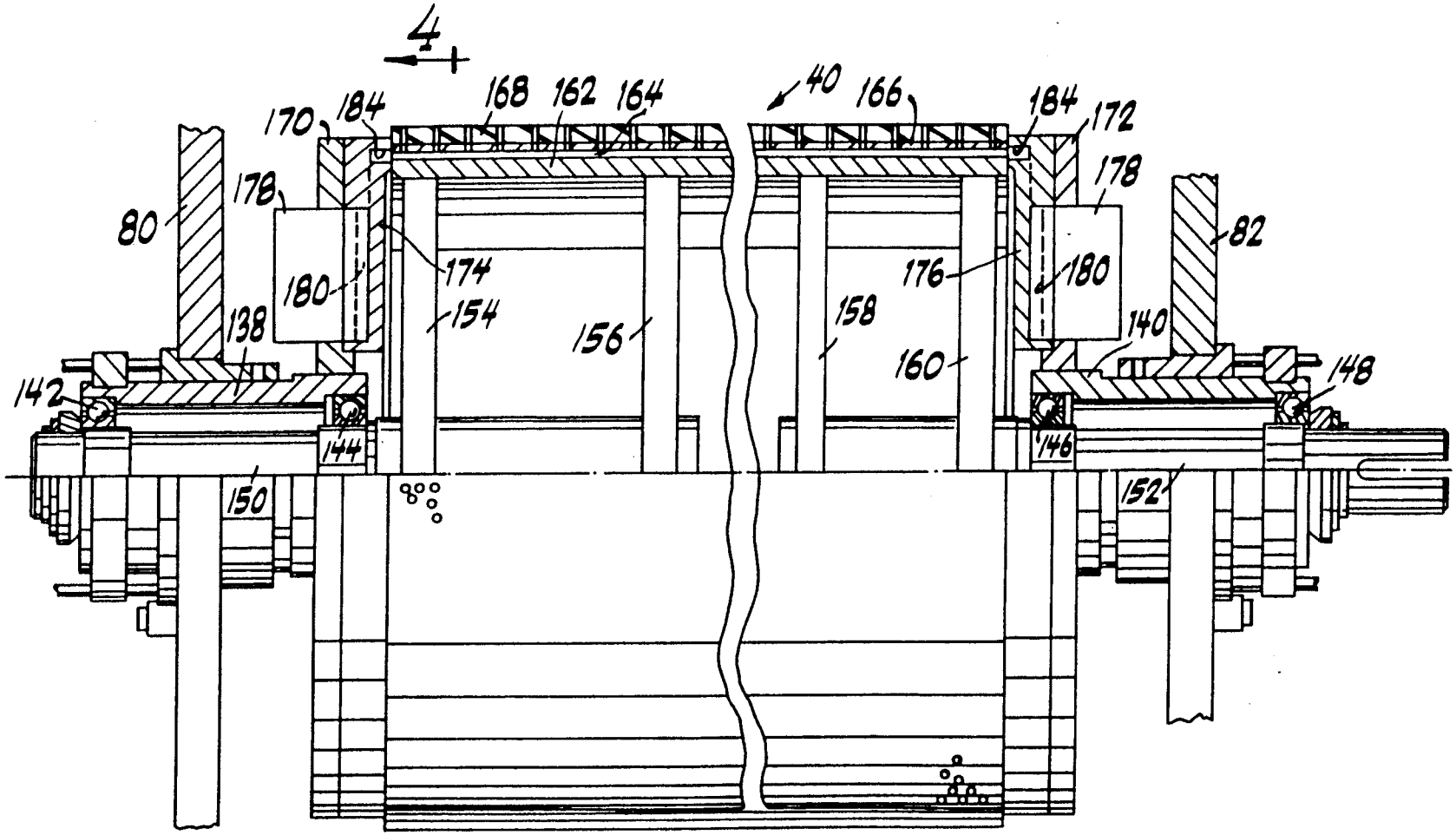
FIG. 3 is an elevation of the vacuum drum employed in our improved method of and apparatus for forming a butt splice with parts of the drum broken away and other parts shown in section.
Figure 4:
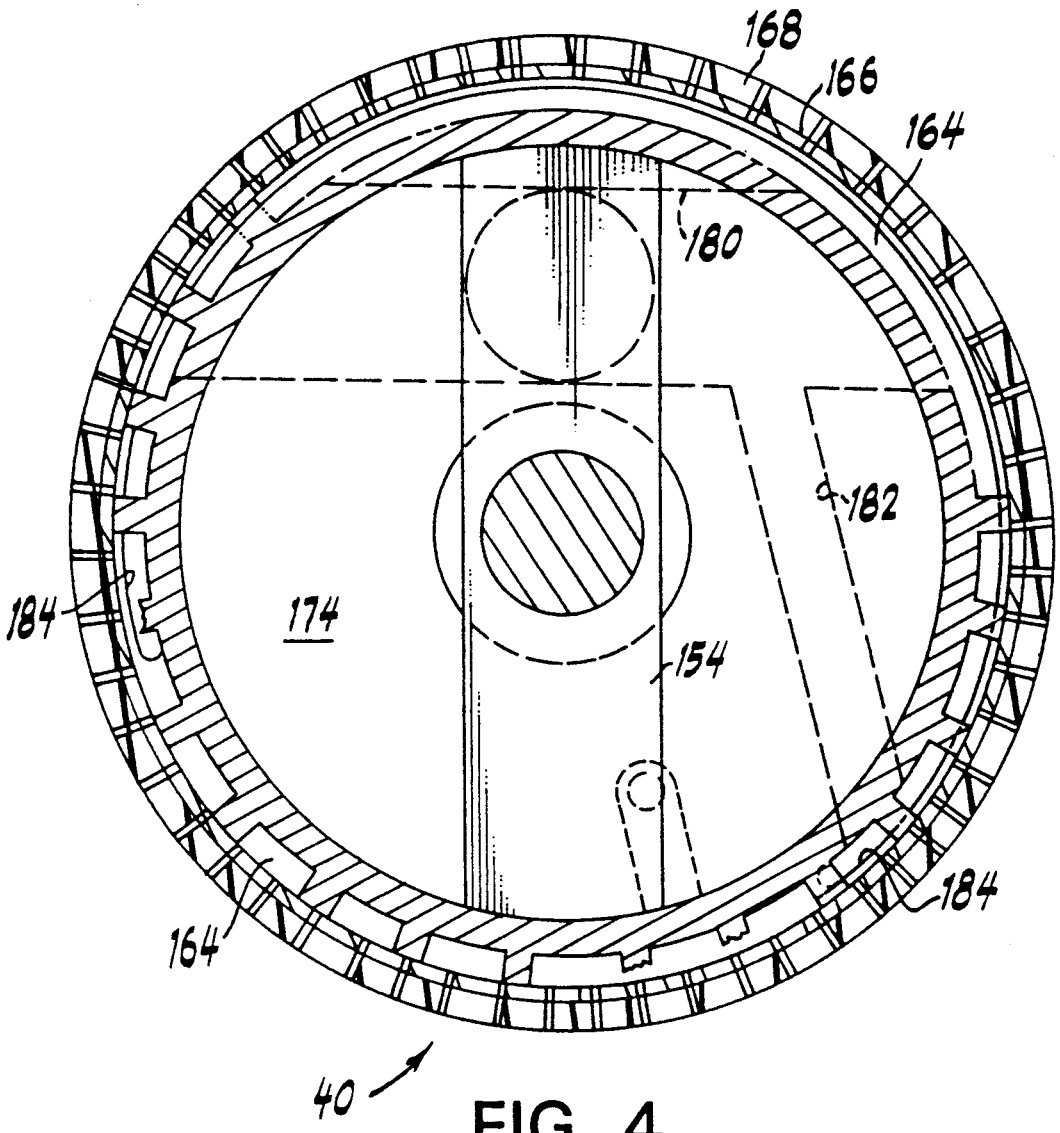
FIG. 4 is a sectional view of the drum shown in FIG. 3 taken along the line 4—4 of FIG. 3.

Referring now to FIGS. 3 and 4, the vacuum drum 40 includes respective sleeves 138 and 140 mounted in frame members 80 and 82. Pairs of bearings 142, 144 and 146, 148 in the respective sleeves 138 and 140 rotatably support coaxial shafts 150 and 152. We weld or otherwise secure a first pair of diametrically extending drum support arms 154 and 156 to the shaft 150. A second pair of drum support arms 158 and 160 are secured to shaft 152. These supporting arms 154, 156, 158 and 160 carry the generally cylindrical drum body 162, the outer surface of which is formed with a plurality of spaced axially extending grooves 164. A perforated skin 166 extending over the outer surface of drum body 162 receives a rubber cover 168.

We mount a pair of stationary drum end plates 170 and 172 on the sleeves 138 and 140 inboard of the frame members 80 and 82. Plates 170 and 172 carry respective seals 174 and 176 associated with the ends of the drum. Each of the seals 174 and 176 may be connected to a suitable source of reduced pressure by means of a connector 178. Each of the seals 174 and 176 has a lateral passage 180 and a branch passage 182 which lead to a peripheral groove 184 in the inner surface of the seal. Each of the grooves 184 communicates with those grooves 164 of body 162 which register with the peripheral grooves 184 of the seal. We so select the circumferential extent of the groove 184 as to be suitable to the particular configuration. For example, this groove may extend from a point just past inlet roll 38 to just past the outlet roller 48 in the direction of rotation of the drum 40.

Figure 5:
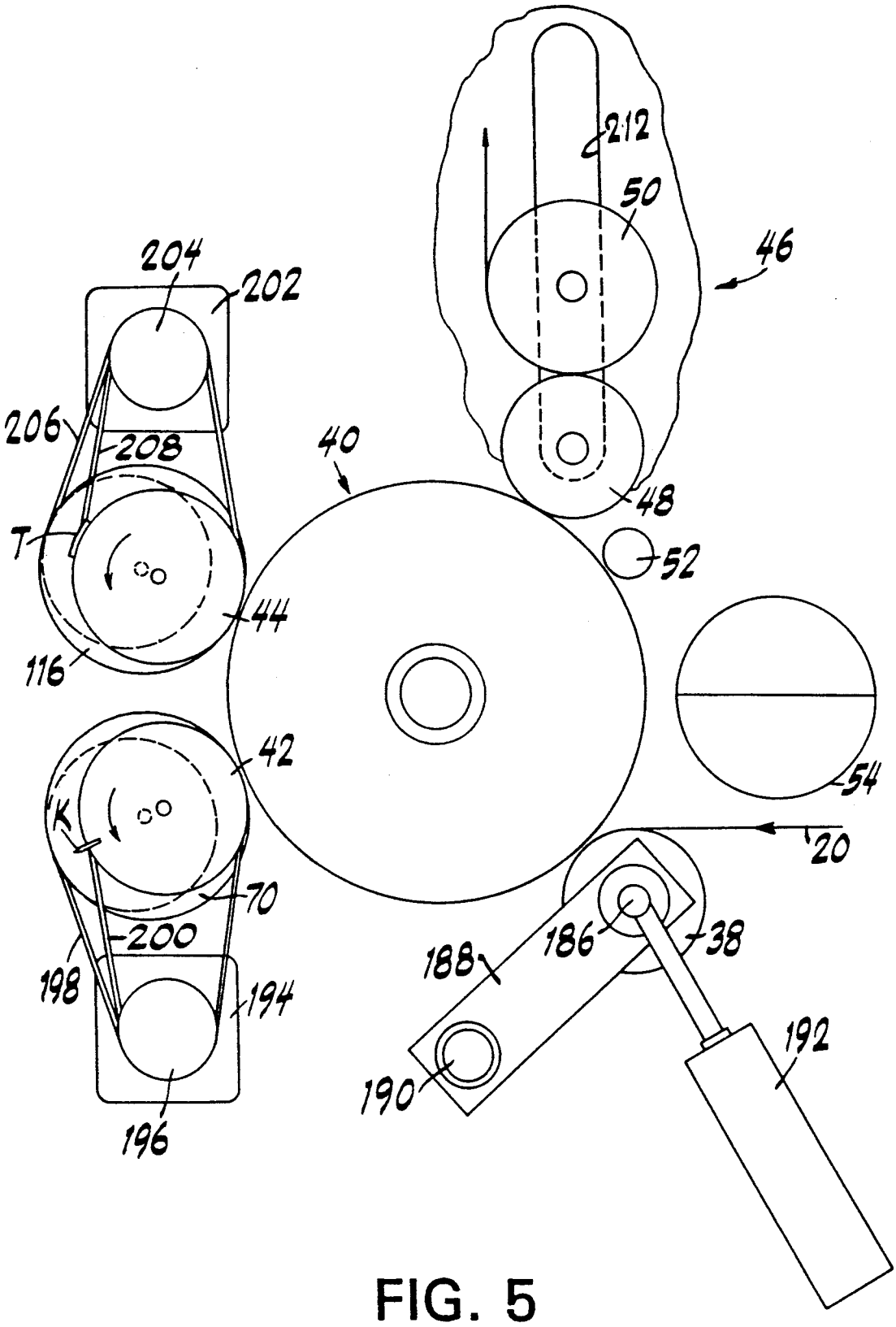
FIG. 5 is a schematic view of the vacuum drum and associated cutting and taping mechanisms of our improved apparatus for carrying out our improved method for forming a butt splice.

Referring now to FIG. 5 in which we have shown the structure associated with vacuum drum 40 in somewhat more detail, intake roller 38 has a shaft 186 supported on an arm 188 pivotable around a pivot 190. A pneumatic cylinder 192 provides pressure for urging the roller 38 into engagement with the surface of the drum 40.

In FIG. 5, we have shown a motor 194 for providing the drive for knife roll 42 and eccentric 70. More particularly, motor 194 drives a double pulley 196 having a first belt 198 for driving the eccentric 70 and a second belt 200 for driving the knife roll itself. It will readily be appreciated by those skilled in the art that the arrangement is such that the knife K carried by roll 42 arrives at the cutting line at approximately the same time as the knife roll is moved to operative position by the eccentric 70.

A motor 202 is adapted to drive a double pulley 204 driving a first belt 206 associated with eccentric 116 and a second belt 208 associated with the taping roll 44. As was the case with the knife roll arrangement, the length of tape T carried by the taping roll 44 arrives at the taping point at approximately the same time as the taping roll 44 is moved to its operative position by the eccentric 116.

In FIG. 5 we have also shown a frame guide slot 112 which may be provided to guide the rolls 48 and 50 of the stack 46.

Our method of forming a butt splice is best understood by reference to FIGS. 6 to 9. As has been explained hereinbefore, we first form a lap splice between the expiring web and the new web. However, in our method, before forming the lap splice we apply a length of relatively stiff material S, the outer surface of which is coated with a breakaway adhesive B to the leading portion NL of the new web N by means of a relatively firm adhesive A. Next, the new roll 26 is brought up to speed and at the proper time bumper roll 32 is actuated to move the expiring web E into contact with the breakaway adhesive B. When that has been done, knife roll 30 is operated to cut the expiring web.

The result of the operation just described is a lap splice comprising the leading portion of the new web, the adhesive A, the stiffener S, the breakaway adhesive B, and the overlying portion of the expiring web E.

Figure 6:
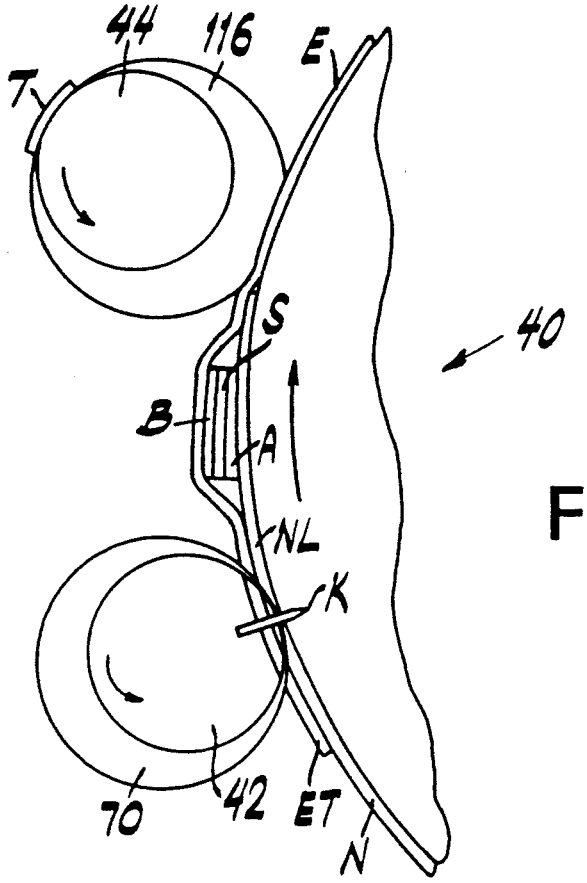
FIG. 6 is a schematic view illustrating one stage in the formation of a butt splice in our improved method.

As the lap splice just described moves past the knife roll 42, the knife roll is actuated to cut through both webs simultaneously in the manner illustrated in FIG. 6. It will be appreciated that in the course of this operation, the knife K enters into the rubber cover 168 of the vacuum roll. Further, as will be understood by those skilled in the art, the trailing edge portion ET of the expiring web which has been severed is carried away by the knife roll through the medium of the vacuum applied through the perforations 104 for later disposal by the operator.

Figure 7:
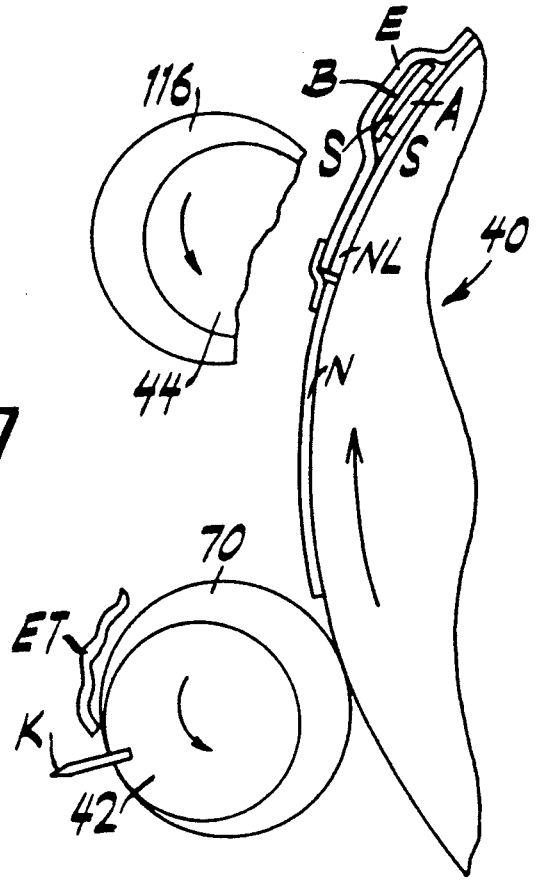
FIG. 7 is a schematic view illustrating a further stage in the operation of forming a butt splice by our improved method.

As the simultaneously cut portions of the expiring and new webs move past the taping roll 44, the length of tape T bridges the cut between the two webs to form the butt splice in the manner illustrated in FIG. 7.

Figure 8:
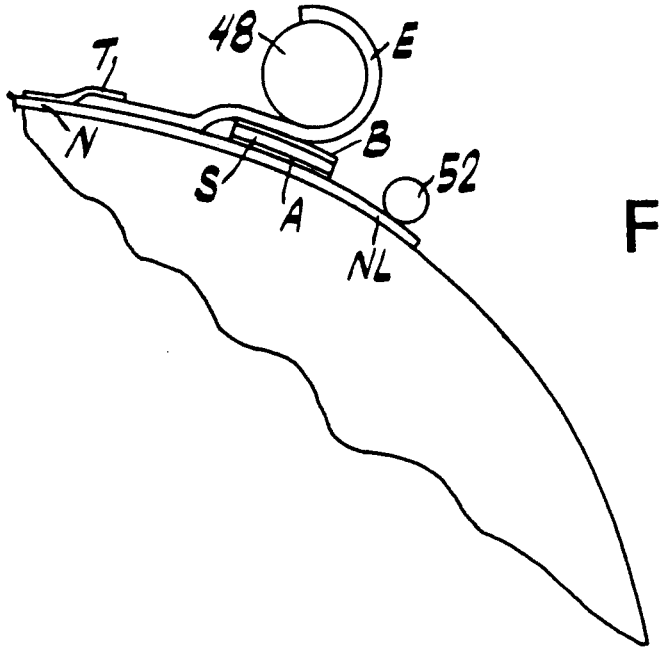
FIG. 8 is a schematic view illustrating a still further stage in the formation of a butt splice in our improved method.

As the expiring web E is trained around the takeoff roller 48, the stiffener S cannot readily follow and tends to move along with the vacuum drum 40 so that the expiring web E is stripped away from the stiffener. To ensure this result, pinch roll 52 engages the severed new web leading portion NL as shown in FIG. 8.

Figure 9:
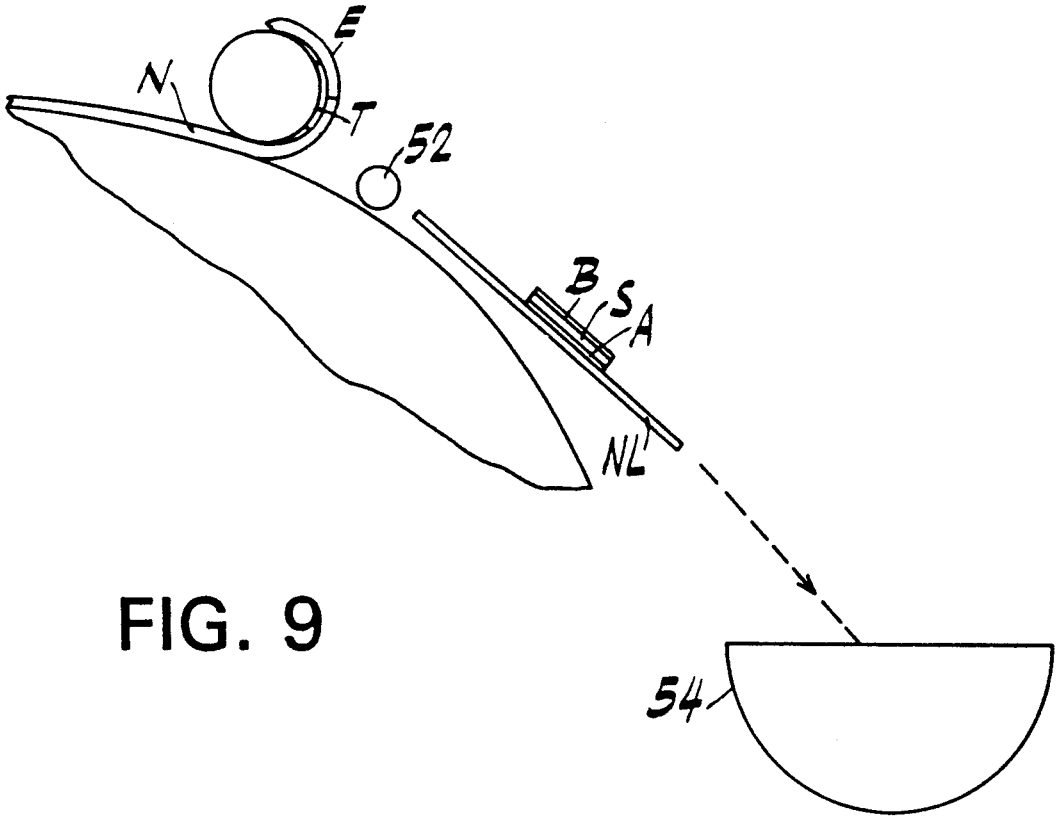
FIG. 9 is a schematic view illustrating the final stage in the formation of a butt splice by our improved method.

Finally, as illustrated in FIG. 9, the expiring web is completely stripped from the stiffener S and it, together with the new web N to which it is butt spliced by tape T, moves around the takeoff roll 48. At the same time, the severed new web leading portion NL, the adhesive layer A, the stiffener S and the breakaway adhesive move into the scrap container 54.

Figure 11:
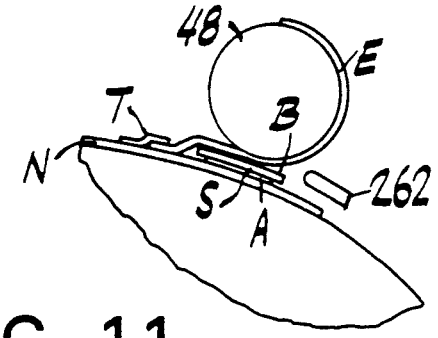
FIG. 11 is a fragmentary schematic view of an alternate embodiment of our invention.

We have discovered that in certain situations it is not possible to position roller 52 sufficiently close to the nip between take-off roller 58 and drum 40 to ensure that the severed new web leading portion is separated completely from the expiring web. Referring now to FIG. 11, in such a situation we position a stationary bar 262 relatively closely adjacent to the nip between roll 48 and drum 40. The bar extends over substantially the full width of the web. Preferably, the edge of the bar facing the nip is rounded.

Figure 10:
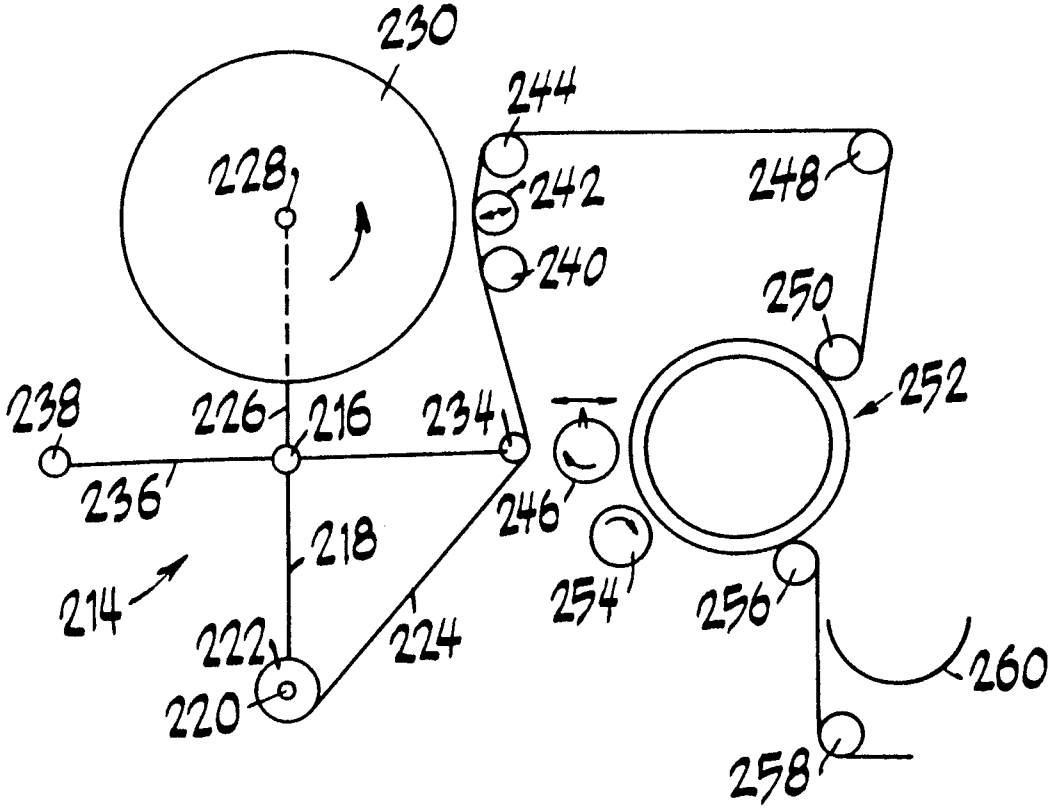
FIG. 10 is a schematic view illustrating an alternate embodiment of our improved apparatus for carrying out our improved method.

Referring now to FIG. 10, in an alternate form of our method of and apparatus for forming a butt splice, a turret unwinder indicated generally by the reference character 214 has a central shaft 216. A first arm 218 carried by the shaft 216 for rotation therewith supports a core 220 carrying the expiring roll 222 of the web 224.

A second arm 226 on shaft 216 extending generally diametrically oppositely to the arm 218 carries the core 228 of a new roll 230.

The expiring web 224 passes from the roll 220 around a rubber covered roll 234 carried by an arm 232 on the shaft 216. The unwinder 214 includes a fourth arm 236 on shaft 216 which supports a rubber covered roller 238.

After leaving the rubber covered roller 234 the web extends over a guide roller 240 and passes a bumper roller 242.

In practice of our method on the apparatus illustrated in FIG. 10, a stiffener S, the outer surface of which carries a breakaway adhesive B, is secured to the leading edge portion of the web of new roll 230 by a relatively firm adhesive A. The stiffener or stiff leader S may be a heavy film of Mylar, for example, having a thickness of 5 or 10 mils so as to be appreciably stiffer than the web. Mylar is the registered trademark of E. I. du Pont de Nemours & Co. for polyethylene terephthalate film. When a splice is to be made, roll 230 is first brought up to line speed. Next, bumper roller 242 is actuated to bring the old web into engagement with the breakaway adhesive on the outer surface of the stiffener. When that has been done, a knife roll mechanism 246 is operated to sever the expiring web.

The knife roll apparatus 246 is such that the knife roll may be brought from a neutral position to the first operative position just described and driven in one direction to perform the web severing operation just described. The apparatus also may be operated to move the knife roll from neutral to a second operative position and to rotate it in the same direction to perform a web severing operation in the course of forming a butt splice.

After the lap splice is formed in the manner just described, the spliced webs move around guide rollers 244 and 248 to an input roller 250 which brings the web into engagement with a vacuum roll 252. After the lap splice has just moved past knife roll 246, the roll is moved to a position adjacent to the vacuum roll 252 and rotated in a direction opposite to the direction of rotation of the roll 252 to sever both webs. Next, a taping roll 254 is driven in the manner described hereinabove in connection with the first embodiment of the apparatus to apply the tape T to the webs to form the butt splice. Finally, the spliced webs are trained around takeoff roller 256 to strip the cut leading edge of the new web, the firm adhesive, the stiffener and the breakaway adhesive from the old web. The cutoff leading portion of the new web together with the stiffener and adhesives fall into a scrap tray 260. Finally, the webs which are butt spliced are carried away by a guide roll 58.

It will readily be seen by those skilled in the art that the form of apparatus illustrated in FIG. 10 has, in addition to the other advantages of our improved method and apparatus, the advantages of being compact and of being able to be retrofitted to existing installations.

It will be seen that we have accomplished the objects of our invention. We have provided a method of and apparatus for forming a butt splice between an expiring web and a new web. Our method and apparatus are especially adapted for use in installations in which the web is required to pass through narrow spaces. Our method and apparatus accomplish their advantageous results without the danger of interfering with the unwinding operation or subsequent processing operations.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is therefore to be understood that our invention is not to be limited to the specific details shown and described.

Having thus described our invention, what we claim is:

1. A method of forming a butt splice between an expiring web and a new web including the steps of forming a lap splice between said expiring web and said new web, conveying said lap-spliced webs sequentially past a cutting station and a taping station, concomitantly cutting said expiring web and said new web at a location upstream of said lap splice with reference to the direction of movement of said webs and taping said new web to said old web at said location to form said butt splice.

2. A method as in claim 1 in which said cutting step results in the formation of a new web severed lead portion carrying a length of splicing tape, said method including the step of separating said new web severed lead portion and the tape carried thereby from said old web.

3. A method as in claim 1 in which said conveying step comprises applying a vacuum to said expiring and new webs between said cutting and taping stations.

4. A method of forming a butt splice between an expiring web and a new web including the steps of adhering a piece of relatively stiff material to said new web, adjacent to the leading edge portion thereof, adhering said expiring web to said relatively stiff piece, concomitantly severing said expiring and new webs at a location adjacent to said stiff piece to cut the tail portion from said expiring web and said leading edge portion from said new web, taping said new web to said expiring web at said location to form said butt splice, and separating said relatively stiff piece together with said leading edge portion from said expiring web.

5. A method as in claim 4 in which said first adhering step is carried out with a relatively firm adhesive and said second adhering step is carried out with a breakaway adhesive.

6. A method as in claim 4 in which said separating step comprises pulling said expiring web away from said stiff piece.

7. A method as in claim 4 in which said separating step comprises turning said expiring web around a relatively small diameter take-off roller.

8. A method of forming a butt splice between a flexible expiring web traveling at line speed and a new web in the course of an unwinding operation, said method including the steps of adhering a piece of relatively stiff material to said new web with a relatively firm adhesive, bringing said new web up to line speed, adhering said expiring web to said relatively stiff piece with a breakaway adhesive, concomitantly severing said new and expiring webs at a location just past said relatively stiff piece with reference to the direction of travel of said expiring web to cut the tail portion from said expiring web and the leading edge portion from said new web, taping said new web to said expiring web at said location, and stripping said expiring web from said relatively stiff piece carrying said leading edge portion of said new web.

9. Apparatus for forming a butt splice between an expiring web and a new web including in combination means for forming a lap splice between said expiring web and said new web, said lap splice forming means comprising means for conveying said expiring web past a first cutting station, means for conveying said lap-spliced webs sequentially past a second cutting station and a taping station, means at said second cutting station for concomitantly severing said expiring web and said new web at a location upstream of said lap splice with reference to the direction of movement of said webs and means at said taping station for applying tape to said webs at said location to form said butt splice.

10. Apparatus as in claim 9 in which said severing means forms a severed new web leading portion, said apparatus including means for separating said severed new web leading portion from said expiring web.

11. Apparatus as in claim 10 in which said conveying means comprises a drum, said separating means comprises a take-off roller for carrying the butt-spliced webs away from said drum at a removal point and a nip roller forming a nip with said drum for receiving said severed new web leading portion to ensure that the severed new web leading portion is separated from said expiring web.

12. Apparatus as in claim 9 in which said conveying means comprises a vacuum drum for sequentially conveying said web past said second cutting and taping stations.

13. Apparatus as in claim 12 in which said cutting means comprises a knife, said vacuum roll having a rubber cover for cooperation with said knife.

14. Apparatus as in claim 9 wherein said severing means comprising knife means common to said first and second cutting stations.

15. Apparatus as in claim 10 in which said conveying means comprises a drum, said separating means comprises a take-off roller for carrying the butt-spliced webs away from said drum at a removal point and a stationary bar adjacent to said removal point for ensuring that the severed new web leading portion is separated from said expiring web.

* * * * *